United States Patent [19]

De Jule et al.

[11] 4,322,659

[45] Mar. 30, 1982

[54] GAS-DISCHARGE DEVICES AND DISPLAY PANELS

[75] Inventors: Michael De Jule, Chicago; Alan Sobel, Evanston; Ralph L. Meyer, Elgin, all of Ill.; David Glaser, Wilton Manor, Fla.

[73] Assignee: Lucitron, Inc., Northbrook, Ill.

[21] Appl. No.: 83,379

[22] Filed: Oct. 10, 1979

[51] Int. Cl.[3] ..... H05B 37/00; H01J 17/00

[52] U.S. Cl. ..... 315/169.1; 313/188; 313/220; 315/169.4

[58] Field of Search ..... 315/169.1, 169.4; 340/758, 759; 313/217, 220, 188

[56] References Cited

U.S. PATENT DOCUMENTS

| | | | |
|---|---|---|---|
| 3,654,388 | 4/1972 | Slottow et al. | 315/169.4 |
| 3,716,742 | 2/1973 | Nakayama et al. | 315/169.4 |
| 3,868,543 | 2/1975 | Holz et al. | 315/169.4 |
| 3,875,442 | 4/1975 | Wasa et al. | 315/169.1 |
| 3,934,172 | 1/1976 | Okamoto et al. | 313/217 |
| 3,978,371 | 8/1976 | Miller | 313/188 |
| 4,053,804 | 10/1977 | Aboelfotoh | 313/220 |

*Primary Examiner*—Harold A. Dixon

*Attorney, Agent, or Firm*—Neuman, Williams, Anderson & Olson

[57] ABSTRACT

A gas-discharge device is provided in which a dielectric member is disposed between a pair of metal members and has one or more openings to provide one or more gas-discharge cells. A surface portion of the dielectric member extends alongside a discharge path in each cell to be placed in a certain charge condition during a gas-discharge and to control field conditions and a timing delay to a subsequent discharge. With the proper applied operating voltage, which may be of alternating polarity, a repeated breakdown operation is obtained at a low frequency. For display applications, a panel is provided having a multiplicity of cells which are operable from a common operating voltage and which develop glow discharges at random times, thereby producing a random flashing or sparkling effect over at least a portion of the panel.

18 Claims, 14 Drawing Figures

92
40
95
93
94
96
49
91
42
97

99
106
107
105
103
102
101
100

110
118
114
113
112
111
116
115

120
126
128
124
122
121
125
129
123

130
132
131

140
141
142
146
144
147
145
149
143
148

GAS-DISCHARGE DEVICES AND DISPLAY PANELS

This invention relates to gas-discharge devices and display panels, and more particularly to gas-discharge devices which provide advantageous timing effects and which may be in the form of display panels which produce attractive flashing or sparkling effects. The devices are simple in construction, versatile and are economically manufacturable either as single units or as multi-unit panels.

BACKGROUND OF THE INVENTION

Gas tubes and other gas-discharge devices have been used extensively in the prior art. In a typical type of arrangement, a relaxation oscillator may be used for timing or flashing purposes, which includes a gas tube connected across a capacitor which is connected through a resistance to a DC voltage supply, the capacitor being charged through the resistor until the voltage across it and across the gas tube is sufficient to cause conduction of the tube and discharge of the capacitor therethrough, initiating another timing cycle.

Gas-discharge devices have also been provided having within a common envelope a large number of separate regions in which discharges may be produced. For example, flat-panel displays have been used including crossing groups of parallel busses supplied with scanning signals to control discharges at crossing points. In another arrangement, opposed charge-storage dielectric members are backed by electrode members, the dielectric members being operative to prevent the passage of substantial conductive current from the conductor members to a gaseous medium.

There are many other arrangements and disclosures in the prior art which might conceivably be considered pertinent, and it would be impossible to identify them all herein. However, it is noted that a basic text is "Gaseous Conductors" by James Dillon Cobine, originally published by McGraw-Hill Book Company in 1941, republished with corrections by Dover Publications, Inc. in 1958. U.S. Patents of possible interest are U.S. Pat. Nos. 3,790,849; 3,829,734; 3,967,157; 3,952,223; 4,010,395; 4,028,578; 4,037,130; 4,039,881; 4,085,350; 4,085,351; 4,090,110; 4,099,082; 4,100,447; 4,109,176; 4,114,064; 4,121,129; 4,126,807; and 4,130,777.

Many of the prior-art arrangements have been very expensive to manufacture and/or require complex circuitry. They have been advantageous only for the applications for which they have been designed, and there has been no recognition that there might be other applications for the arrangements or portions thereof. There has also been no recognition of phenomena which may take place during the operation of the prior-art arrangements and which might be used to advantage under appropriate conditions.

SUMMARY OF THE INVENTION

This invention was evolved with the general object of providing improved gas-discharge devices and systems using such devices, and it provides gas-discharge devices having internal constructions such as to obtain highly advantageous timing effects usable for obtaining oscillatory actions, periodic flashes, and other desirable operations. The devices are simple and are readily and economically manufacturable, and systems are provided using devices which have a large number of cells or units in a common envelope for producing random flashing or sparkling effects for visual purposes.

This invention is based upon the discovery of a random flashing effect produced by a certain gas-discharge panel when a certain range of operating voltages was applied thereto. The panel was made for general experimental purposes and included an envelope having a glass plate as a front wall and a first metal plate as a rear wall. A second metal plate was disposed behind the glass plate and a separating sheet of dielectric material was disposed between the first and second metal plates, the insulating sheet and the second metal plate having aligned openings forming gas-discharge cells in a row-column array. It was discovered in the initial experimental work that with neon gas in the envelope and with the two metal plates connected to a 220–440 volt 60 Hz source through a resistor having a value of from 100,000 to 300,000 ohms, the individual cells flashed at random times and at frequencies on the order of 1 Hz to produce a sparkling effect over the surface of the panel.

A complete and exact scientific explanation for the phenomenon cannot be provided. However, it is noted that in each cell there is a restricted path between surface portions of the metal plates, the restricted path being defined by surface portions of the sheet of dielectric material. Observations and results of a number of experiments show that the dielectric material operates to control field conditions along the restricted path as a function of time, being operative in the experimental panel to control the times of production of the gas discharges.

Such observations and results also show that the controlling effect is quite strong and that long time delays of the order of 1 second or more can be readily obtained even though the physical size of the cells is quite small. Thus, a timing device is provided which will produce a long time delay while being very compact as well as being simple and inexpensive. The device does not require a separate capacitor element as used in prior-art timing-circuit arrangements.

Important features of the invention relate to the use of the devices in producing repeated breakdowns in which each gas discharge is extinguished following production thereof to place the dielectric material in a certain charge condition and to allow the charged material to control the time to a next subsequent operation. The gas discharge may be extinguished by providing circuitry which reverses the direction of the operating voltage or which otherwise reduces the operating voltage below a value sufficient to maintain the discharge. A periodically varied operating voltage is highly advantageous for many applications in that it can be readily obtained. For example, an AC voltage such as a 60 Hz voltage may be used as an operating voltage with the device being so constructed as to require application of a number of cycles of the operating voltage between each gas discharge and the production of the next discharge. Thus, the frequency of the gas discharges may be a submultiple of the frequency of the operating voltage.

Further important features relate to the manner of construction of the device to obtain desired and advantageous operational characteristics and to facilitate manufacture thereof. Preferably, a surface portion of a dielectric material is used in defining a discharge path between electrode surface portions and the surface portion of the dielectric material extends alongside the discharge path for at least a portion of the length of the path. It is also desirable that the surface portion of the dielectric be in surrounding relation to the discharge path.

In addition, important advantages may be obtained with a construction in which the surface portion of a first electrode at an end of a discharge path has an area which is a small fraction of the area of a surface portion of a second electrode at the opposite end of the path. The first electrode, with a small-area surface portion, acts as an anode for discharges in the direction which produces the most current, and hence, the most light while the second electrode, with the larger area, acts as a cathode for such discharges. With the reverse polarity of applied voltage, the first electrode limits the discharge current because of its size.

In general, it is advantageous that the discharge current be asymmetrical, that is, that it be significantly larger for one polarity of applied voltage than for the reverse polarity. This asymmetry may be obtained by differing surface areas of the two electrodes, by altering their gas-discharge properties by other means, such as by using metals of differing work function or secondary emission ratios, or by external circuit means, such as a diode in series with the power source.

Additional, very important features of the invention relate to the incorporation of a large number of discharge units in a common envelope, such being usable to provide a sparkling or random flashing operation which is highly desirable in certain display applications. A highly advantageous panel construction is provided which incorporates the aforementioned constructional features, and in which a sheet of dielectric material is disposed between first and second metal plates, the first metal plate and the dielectric sheet having aligned openings defining a plurality of discharge paths. The first metal plate may be behind a transparent wall forming one wall of an envelope, while the second metal plate may form an opposite wall of the envelope.

In one embodiment, the openings in the dielectric sheet may be of small size to expose a small-area surface portion of the second metal plate, which may operate as an anode, and the first metal plate may be relatively thick to provide annular inwardly facing surface portions having relatively large areas to serve as cathodes.

In a second embodiment, the openings in the dielectric sheet may be relatively large to expose relatively large-area surface portions of the second metal plate, which may operate as a cathode, and the first metal plate may be quite thin to provide annular inwardly facing surface portions having relatively small areas to serve as anodes.

In both embodiments, the openings in the dielectric sheet may be smaller than the openings in the first metal plate, and the surface portions of the members which are alongside the discharge paths include portions of the dielectric sheet extending radially outwardly from the openings therein, as well as inwardly facing surface portions of the openings.

Additional embodiments are disclosed, including one in which the surface portion of a member of dielectric material is of conical shape, another in which a surface portion of an electrode is of conical shape, another in which one or more discharge cells are provided between two transparent glass plates with a glow discharge being visible from either direction, and another embodiment in which a metal electrode is contained within a member of dielectric material and is connectable to a control voltage source for controlling the rate and/or timing of production of discharges.

In additional embodiments, elements are provided of fabric form, including electrode elements of a conductive fabric such as a wire mesh and charge-collecting elements of an insulating fabric such as a woven fiber glass or a felted fabric such as an aluminum oxide paper or a paper of glass fibers.

A thin layer of a phosphor material is provided in still another embodiment to be excited by ultraviolet radiation from a gas discharge to produce a luminescent glow in the visible portion of the spectrum. Such a layer may also be provided in other embodiments according to the invention.

Still further features of the invention relate to the supply of operating voltages in relation to the characteristics of the dielectric material and other parameters in a manner such as to obtain highly effective and reliable operation.

This invention contemplates other objects, features, and advantages which will become more fully apparent from the following detailed description taken in conjunction with the accompanying drawings.

DESCRIPTION OF THE PREFERRED EMBODIMENTS

Figure 1:
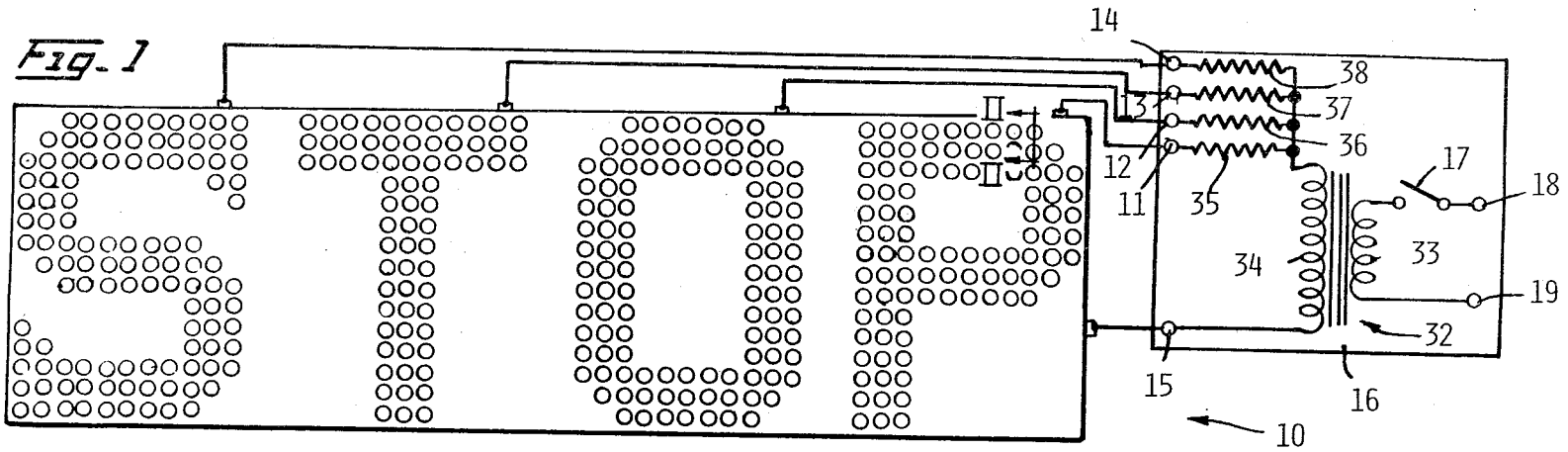
FIG. 1 shows a display panel construction in accordance with the invention, and also shows schematically an operating voltage source for the panel.

Reference numeral 10 generally designates a display panel constructed in accordance with the principles of the invention. The panel 10 has electrical terminals connected to terminals 11–15 of an operating power source 16 which includes an on-off switch 17, and which is connected to terminals 18 and 19 connectable to a 120 volt 60 Hz voltage supply, for example. The panel 10, as illustrated, is arranged to produce the four letters of the word "STOP" with a sparkling, random flashing lighting effect through the areas which define each letter. It will be understood, of course, that the invention is not limited to displays or to any particular display format.

Figure 2:
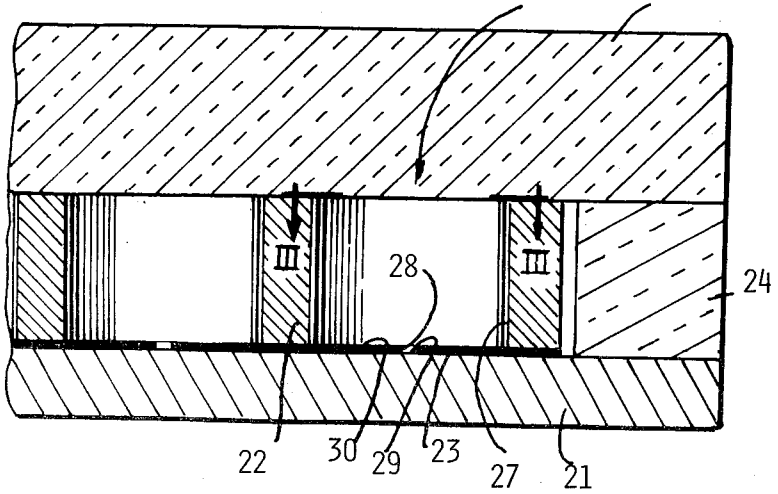
FIG. 2 is a sectional view, on an enlarged scale, taken substantially along line II—II of FIG. 1 and showing the construction of discharge cells of the panel.

The illustrated display panel 10, as shown in FIG. 2, comprises a front wall 20 of transparent material, preferably glass, and a rear wall 21 which may preferably be a metal plate, and which may form an anode electrode of the panel to which power supply terminal 15 is connected. Another metal plate 22 is disposed behind the front wall 20 and may form a cathode electrode of the panel to which power supply terminal 11 is connected. A sheet 23 is disposed between the metal plates 21 and 22 and is of a dielectric material. A peripheral wall 24, preferably of glass, is disposed around the peripheries of the metal plate 22 and the dielectric sheet 23 and is bonded and sealed to the front wall 20 and rear wall or plate 21, thereby providing an envelope which is filled with an ionizable gas.

Figure 3:
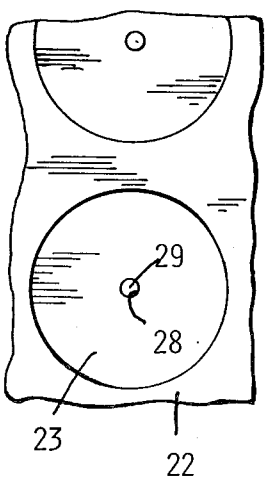
FIG. 3 is a sectional view taken substantially along line III—III of FIG. 2.

To produce the sparkling, random flashing effects, a multiplicity of gas discharge units or cells are provided. Two of such cells are shown in FIG. 2, which is a cross-sectional view, on a greatly enlarged scale, of a portion of the panel 10 which forms part of the letter "P" adjacent one edge of the panel 10. One of the cells shown in FIG. 2 is also shown in FIG. 3 and is designated by reference numeral 26. Cell 26 is formed by providing aligned openings in the metal plate 22 and the dielectric sheet 23. The opening in metal plate 22 is defined by an inwardly facing annular surface portion 27, and the opening in sheet 23 is defined by an inwardly facing annular surface portion 28, a surface portion 29 of the rear plate 21 being opposite the opening in sheet 23. The diameter of the opening in plate 22 is larger than that in the sheet 23, exposing a surface portion 30 of sheet 23 which extends radially outwardly and away from the opening therein.

When a suitable operating voltage is applied to plates 21 and 22, glow discharges are produced periodically in the path through the ionizable gas between surface portions 27 and 29 of the plates 21 and 22, such glow discharges being visible through the transparent front wall 20. With the construction of FIGS. 1-3, each cell operates as a free-running oscillatory device, producing flashes at a rate which may be on the order of 1 Hz, for example. With a plurality of cells having constructions which are identical in all respects, with identical gas composition, pressures and temperature in all cells and with identical magnitude, frequency and wave shape of voltage applied to all cells, it might theoretically be possible to produce periodic synchronized gas discharges in all cells in unison. In practice, however, and without some means of synchronization, there are very small variations which produce differences in the frequency-phase relationships of the discharges and the result is a sparkling, random flashing effect.

In the illustrated arrangement, an operating voltage of alternating polarity is applied from the power source 16 which includes a transformer 32 having a primary winding 33 connected through the switch 17 to the voltage supply terminals 18 and 19 and having a secondary winding 34. One terminal of the secondary winding 34 is connected to terminals 11-14 through series impedances such as ballast resistors 35-38, and the other terminal thereof is connected to the terminal 15. In the illustrated panel 10, the plate 22 defines the cathode electrode for the cells which define the letter "P" and the additional plates are provided to define the letters "O," "T" and "S," being respectively connected to terminals 12, 13 and 14, the plate 21 defining a common anode electrode for the cells of all letters. Thus, separate series impedances are provided for separate groups of cells. It will be understood, of course, that a single impedance might be used for all cells of a panel. It is also noted that no series impedance at all is necessary with certain constructions, as hereinafter noted in connection with FIG. 4.

By way of illustrative example, the transformer secondary winding 34 may supply a voltage of about 220 volts R.M.S. at a frequency of 60 Hz and each of ballast resistors 35-38 may have a resistance of about 47 K.

Also by way of illustrative example, a panel may be provided having approximately 240 cells for each letter, the gas may be neon at a pressure of on the order of 18 Torr; the plate 22 may be of aluminum having a thickness of 0.090 inches with the surface 27 having a diameter of 0.125 inches; and the sheet 23 may be of a mica material, available commercially under the trademark "Micamat," having a thickness of 0.004 inches with the diameter of the surface 28 being 0.010 inches.

With a panel and an operating voltage source according to the foregoing example, glow discharges substantially covering surface 27 are produced by each cell at a frequency of the order of 1 Hz. Each such glow may appear to be toroidal or doughnut-shaped and to cover the surface portion 30 of sheet 23, as seen through front wall 20.

In addition, a small glow discharge may be observed within the opening 28 in dielectric sheet 23 over the surface portion 29. The small glow discharge may be produced intermittently under certain circumstances, but in the conditions set forth in the foregoing example, the small glow discharge may appear to the viewer to be continuous.

The large and small glows observed from such discharges appear to be glows known as negative glows, the large glows being produced during half cycles when the plate 22 is negative and the plate 21 is positive, and the small glows being produced during half cycles when the plate 21 is negative and the plate 22 is positive. It appears further that the difference in size is due in part to the fact that the surface portion 27, which operates as a cathode in producing the large flow, has an area which is much greater than that of the surface portion 29, which operates as a cathode in producing the small glow in the opening 28.

It is also noted that when the waveform of the current through the device is produced on the screen of a cathode ray oscilloscope, current spikes of large amplitude may be observed during half cycles of one polarity, in which the plate 22 is negative while the amplitude of current during half cycles of the opposite polarity is relatively low. By way of example, the current during half cycles of the one polarity may be approximately 10 times as high as during half cycles of the opposite polarity.

With regard to the effect of the dielectric material, it is noted that the inwardly facing surface portion 28, which defines the opening in the dielectric sheet 23 and the surface portion 30, which extends radially outwardly to the surface portion 27, extend alongside of the discharge path between the surface portion 29 and the surface portion 27, and the charge distribution along such surface portions 28 and 30 will affect the field distribution along the discharge path. During the large amplitude discharge, the dielectric material is placed in a charge condition such as to oppose initiation of a subsequent discharge of the same polarity, and it requires a certain time period for the charge condition to so change as to permit initiation of a subsequent discharge. It is believed that current flowing in the opposite direction discharges the dielectric over many half-cycles.

It is possible also that thermal, pressure and/or other effects may be significant, but it appears that the charge condition of the dielectric material, its response to discharge currents, and its effect on field conditions are of a controlling nature.

Figure 4:
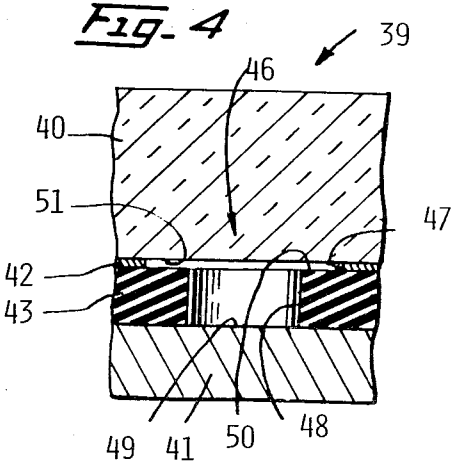
FIG. 4 is a sectional view similar to a portion of FIG. 2 and illustrating the construction of a modified panel.

FIG. 4 is a cross-sectional view similar to FIG. 2, but illustrating a modified panel generally designated by reference numeral 39 and including a front glass wall 40, a back wall 41 in the form of a metal plate, a metal plate 42 behind front wall 40, and a dielectric sheet 43 between plate 42 and plate 41. One cell is shown which is designated generally by reference numeral 46, it being understood that many additional cells may be provided. An opening in plate 42 is defined by an inwardly facing annular surface portion 47, and an opening in sheet 43 is defined by an inwardly facing annular surface portion 48, a front surface 49 of the rear plate 41 having a portion exposed by the opening in sheet 43.

The construction is thus similar to that of FIG. 2 and is additionally similar in that the diameter of the opening in plate 42 is larger than that in sheet 43, exposing a surface portion 50 of sheet 43 which extends radially outwardly from the opening therein. However, the panel 39 is different from the panel 10 in that the plate 42 is quite thin so that the surface of the glass plate 40 is closer to the discharge path and the charge distribution thereon may have a greater effect.

Also the area of the surface portion 47 is quite small while the diameter of the opening in the sheet 43 is relatively large so that the area of the surface portion 49 is quite large. Consequently, the area of the surface portion 47 is a small fraction of the area of the surface portion 49, and when a voltage of alternating polarity is applied between the plates 41 and 42, the plate 41 operates as a cathode in producing large glow discharges during half cycles of one polarity while the plate 42 operates as a cathode in producing glow discharges of relatively small size during half cycles of the opposite polarity.

It is noted that the operating voltage source 16 may be used for the modified panel 39 but with terminals of the secondary winding 34 being directly connected to plates 41 and 42. By way of example, and not by way of limitation, an operating voltage of 300 volts RMS, 60 Hz, may be used, and the gas pressure may be from 10 to 60 Torr, using neon gas. The plate 42 may have a thickness of from 0.0005 to 0.003 inches, the diameter of the openings therein may be 0.125 inches, and the sheet 43 may have a thickness of 0.030 inches with the openings therein having a diameter of 0.078 inches. It is noted that a panel with such a construction has been operated successfully from the secondary winding of a transformer with no ballast resistor in series therewith.

In the modified panel 39, large glow discharges are observed within the opening in the sheet 43, within surface portion 48. In addition, small, intense glows are observed extending along radial lines over surface 50. The positions of these lines occasionally shift during operation. It is believed that these small linear discharges are pinched positive columns. Further, it appears that each such discharge produces a charge condition on the adjacent portion of surfaces 50 and 51 which produces a field which opposes production of a subsequent discharge in the same region until this charge is neutralized or discharged.

Figure 5:
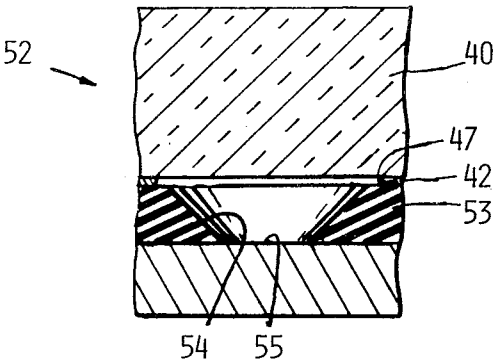

Referring to FIG. 5, reference numeral 52 generally designates a modified construction which is similar to that of FIG. 4, including a front glass wall 40, the metal plate back wall 41 and the metal plate 42 having the surface portion 47 which defines an opening therein. The construction 52 includes a dielectric sheet 53 which is similar to the dielectric sheet 43 of FIG. 4, but which has an opening defined by an inwardly facing annular surface portion 54 of conical shape, a front surface 55 of the rear plate 41 having a portion exposed by the opening in the sheet 53.

Figure 6:
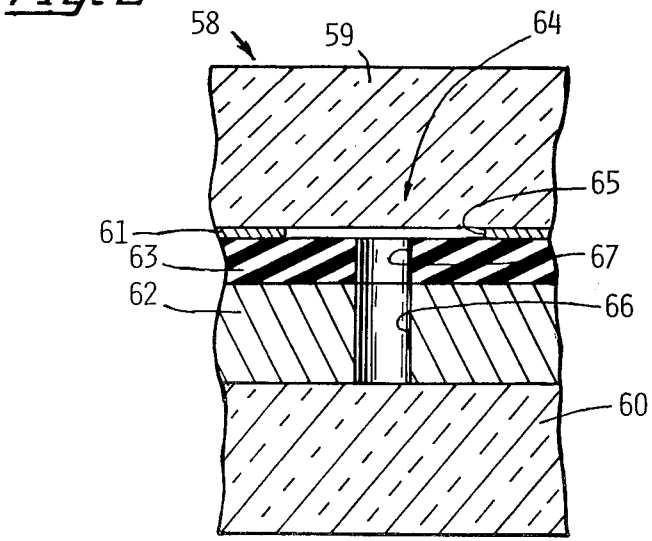

In FIG. 6, reference numeral 58 generally designates another modified construction which includes opposite glass walls 59 and 60, metal plates 61 and 62 disposed adjacent the inside surfaces of the glass plates 59 and 60 and a member 63 of dielectric material between the metal plates 61 and 62.

To define a gas-discharge cell, generally designated by reference numeral 64, the metal plates 61 and 62 and the dielectric member 63 have openings defined by surfaces 65, 66 and 67, respectively, the openings being on a common axis.

In the construction as illustrated, the plate 61 is relatively thin, while the plate 62 is relatively thick, and the diameter of the surface 65 is larger than the diameters of the surfaces 66 and 67 which are the same. In this construction, the area of the surface 65 is considerably smaller than that of the surface 66 and surface 65 operates as an anode while surface 66 operates as a hollow cathode.

An advantage of the construction of FIG. 6 is that glow discharges produced in the cell 64 are visible from either direction, either through the glass plate 59 or through the glass plate 60.

Figure 7:
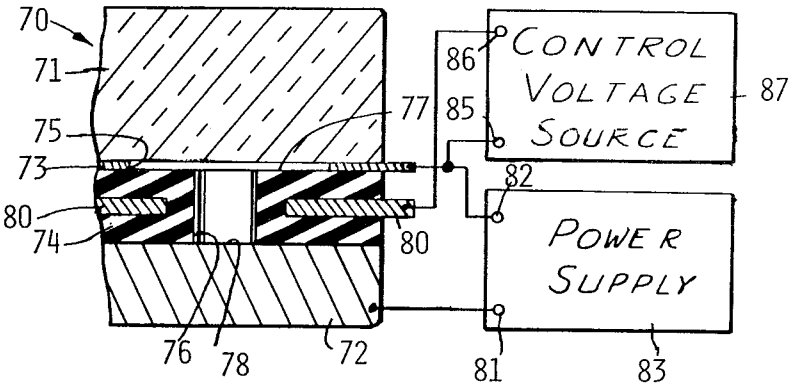
FIGS. 5, 6, 7, 8, 9, and 10 are additional sectional views which are similar to a portion of FIG. 2 and which illustrate additional modified constructions.

Referring to FIG. 7, reference numeral 70 generally designates another modified construction including a front glass wall 71, a metal plate 72 forming a rear wall, a metal plate 73 behind the front glass wall 71 and a member 74 of dielectric material between the metal plates 72 and 73.

To define a gas-discharge cell, the metal plate 73 and the dielectric member 74 have openings defined by surfaces 75 and 76 on a common axis, the dielectric member 74 having a front surface 77 around the opening therein and a front surface 78 of the rear plate 72 having a portion exposed by the opening and the dielectric member 74. The construction as thus far described is thus quite similar to that of FIG. 4. However, in the construction of FIG. 7, the metal member 80 is disposed within the dielectric member 74, the metal member 80 being separated from the gas-discharge region by portions of the dielectric member 74.

The metal plates 72 and 73 may be connected to terminals 81 and 82 of a power supply 83 as diagrammatically illustrated and the operation may be similar to that of the previously described devices with periodic gas discharges being produced. However, terminals 85 and 86 of a control voltage source 87 may be connected to the plates 73 and 80 as illustrated, to control the rate of production of discharges and/or the timing of production of the discharges. By way of example, the source 87 may supply a periodic pulse to cause discharges of all cells in a panel or in one portion of a panel at the same time. Such a control is possible because the potential of the plate 80 has an effect on the charge distribution in the adjacent portions of the dielectric member 74.

Figure 8:
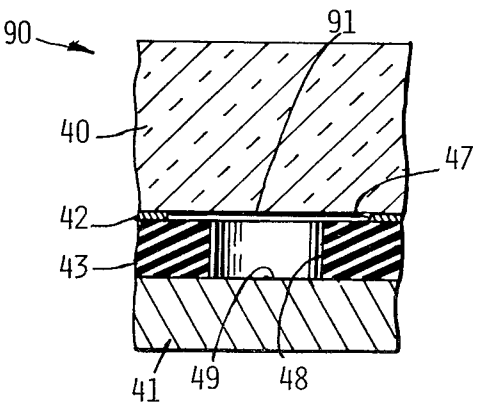

Referring to FIG. 8, reference numeral 90 generally designates another modified construction which is substantially the same as the construction of FIG. 4 except that a thin layer 91 of a suitable phosphor is disposed on the rearward surface of the front glass wall 40. The gas used in the device and the type of phosphor used for the layer 91 may be such as to cause excitation of the phosphor layer 91 at a wavelength in the ultraviolet portion of the spectrum and to cause fluorescence of the phosphor layer in the visible spectrum. It will be understood that a similar layer of phosphor material may be used in any of the other constructions according to the invention and may be used on surfaces other than the rear surface of a front glass wall. For example, the phosphor may be applied to a surface portion of the charge-control dielectric material.

Figures 9, 10, 11, 12, 13, 14:
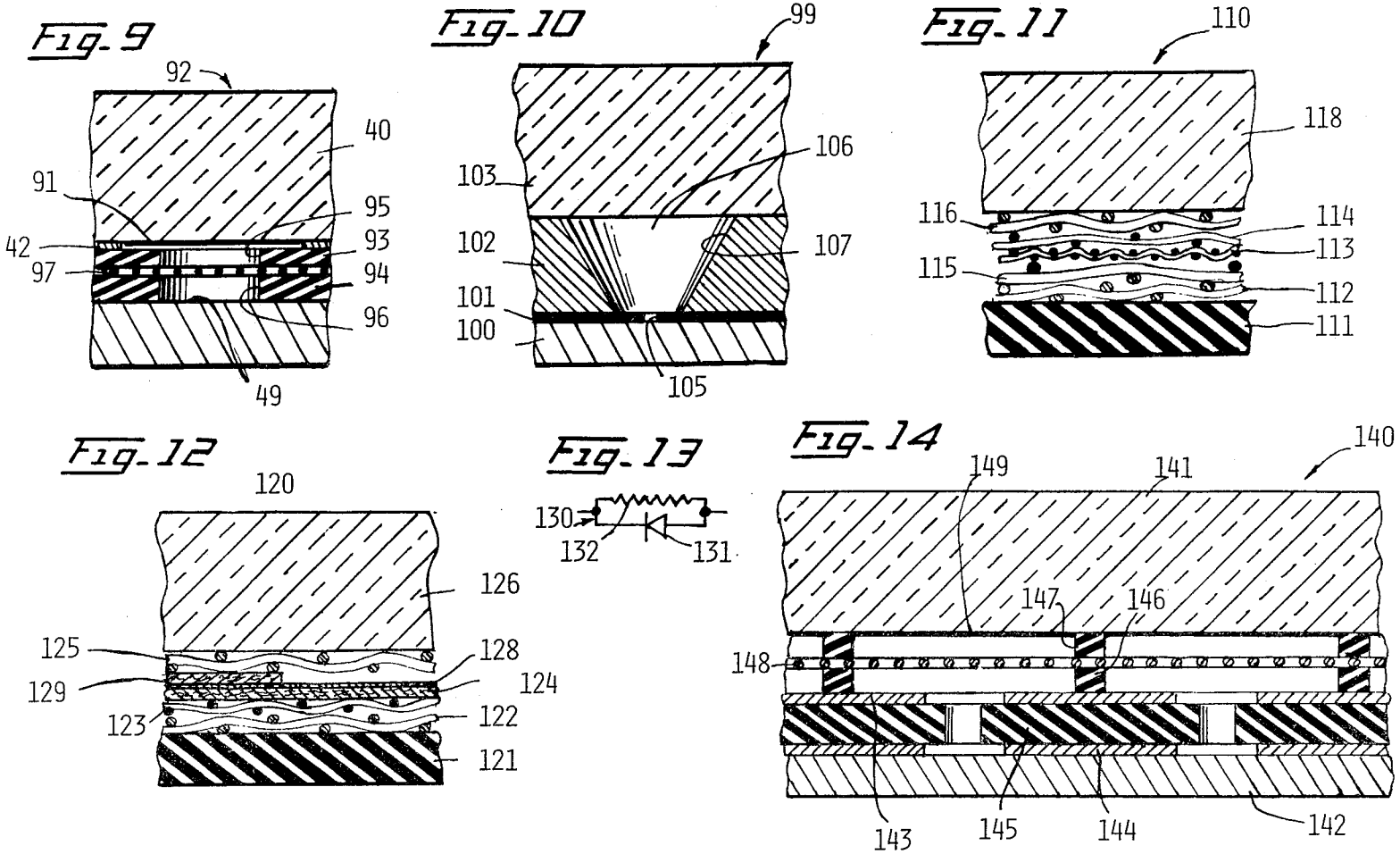
FIGS. 11 and 12 are additional sectional views illustrating constructions including electrode and charge-collecting elements of fabric.
FIG. 13 shows an impedance usable with a power source to obtain or increase asymmetry in the discharge current.
FIG. 14 is a sectional view illustrating still another modified construction.

Referring to FIG. 9, reference numeral 92 generally designates a further modified construction which is similar to that of FIG. 8 and includes the thin layer 91 of a suitable phosphor on the rearward surface of the front glass wall 40. In the construction 92, the dielectric sheet 43 is replaced by a pair of dielectric sheets 93 and 94 which have openings defined by surface portions 95 and 96, corresponding to the opening which is defined by surface portion 48 of sheet 43. A metallic grid 97 is sandwiched between sheets 93 and 94 to extend across the openings defined by surface portions 95 and 96 and to be disposed between surface 49 and the plate 42. The grid 97 shields the phosphor 91 and the front glass wall from material which may be sputtered from the surface which acts as a cathode, such as surface 49.

Referring to FIG. 10, reference numeral 99 generally designates still another embodiment which includes a plate 100 operative as a rear electrode and as an anode in the direction of major current flow. A thin sheet 101 of dielectric material is disposed on the front surface of plate 100, a metal plate 102 is disposed on the front surface of sheet 101 and a transparent front wall 103 is disposed on the front surface of plate 102. The sheet 101 has a small opening 105 which defines the active surface portion of the electrode 100. A discharge region 106 is defined by a conical surface 107 which has an area much greater than that of the active surface portion of the plate 100 to operate as a cathode in the direction of major current flow. A gaseous discharge, when produced, is seen through the transparent front wall 103 as occupying a large part of the region 106. The conical surface 107 operates to reflect the light produced by the discharge out through the front wall 103. Surface 107 may preferably be polished to enhance the reflection of light.

Referring to FIG. 11, reference number 110 generally designates another modified construction which includes elements of fabric form. A solid rear wall 111 is provided which may preferably be of an insulating material but might be of a conductive material. An element 112 is disposed against the front surface of rear wall 111 and is of a conductive fabric material, preferably of a wire mesh. Element 112 is a cathode electrode, i.e., an electrode from which electrons flow during the gaseous discharge phase in which the greater amount of light is produced. A pair of elements 113 and 114 are disposed in front of the element 112 and are of insulating materials to operate as charge collectors. The elements 113 and 114 are of woven fabric materials. Additional spacer elements, such as 115, which may also be of a woven fabric insulating material, may be provided between element 113 and the cathode electrode element 112.

An anode electrode element 116 is disposed in front of the element 114 and behind a transparent front wall. Element 116 is of a conductive fabric material, preferably a wire mesh.

The elements 113, 114, and 115 provide openings between the cathode and anode electrode elements 112 and 116 for production of random discharges which can be viewed through the transparent front wall. The rate at which discharges are produced in an opening is determined in part by the charge collections of the elements 113, 114, and 115, and especially of the elements 113 and 114 in the illustrated construction in which the spacer element 115 has a relatively coarse mesh and the elements 113 and 114 have a finer mesh.

It is noted that most of the light generated by the random discharges is generated near the rearward cathode electrode 112 and the diffusion of the light through the electrodes 113–115 gives a very pleasing effect.

It is also noted that the fabric elements need not be precisely formed, and ordinary commercial tolerances can be used. Preferably, the elements which are of woven insulating material are of fiberglass material or the like, which has excellent characteristics for obtaining optimum operation. However, such materials are usually manufactured with an organic lubricant to facilitate handling of the materials and to minimize breaking of individual glass strands. When such a material is used, the lubricant material is preferably removed, which may be accomplished by burning either before assembly of the device or after assembly and before the device is pumped and sealed. When the lubricant material is burned out before assembly, extra care must be exercised during assembly to prevent breakage of the insulating material.

Referring to FIG. 12, reference numeral 120 designates a further modified construction which has elements of fabric form, including insulating elements of a felt material. The construction 120 includes a solid rear wall 121 which may preferably be of an insulating material and a cathode electrode member 122 of a conductive fabric material such as a wire mesh, disposed against the front surface of rear wall 121. A spacer element 123 may be disposed against the front of member 122 and may be of a woven fabric insulating material. The next layer is an element 124 of insulating felt material which is coarse enough to allow gas particles and light to diffuse freely through it. For example, element 124 may be of a ceramic felt material, such as an aluminum oxide paper made from many short lengths of small-diameter oxide fibers, or it may be a similar material made of glass fibers.

An anode element 125 is disposed in front of the element 124 and behind a transparent front wall 126.

The construction 120 of FIG. 12 may make use of light produced by a phosphor and, in the illustrated arrangement, a phosphor material 128 is provided in the form of a powder which is dusted into the front surface of the element 124.

In addition, a spacer sheet 129 of insulating material may be provided between portions of the front of the element 124 and the front wall. Such a sheet may be formed with cut-out portions to define those areas of a panel which should produce light, and those areas which should produce less or no light, for various artistic effects. The spacer sheet 129 may be of the same material as element 124 or may be of a solid and opaque insulating material to insure production of no light from covered areas when such is desired.

With regard to the supply of power to the various embodiments of this invention, it may be desirable to provide a power source such as to cause or contribute to asymmetry in the discharge current. For example, the power source may include an AC source and a series impedance such as impedance 130 shown in FIG. 13, comprising a diode 131 and a parallel resistor 132. Such an impedance may be particularly advantageous when there is not a great deal of asymmetry in the electrode structure, as is the case with the construction of FIGS. 11 and 12.

It is also noted that the flashing rate of devices of the invention has been found to be a function of the applied voltage, being increased when the applied voltage is increased in magnitude. The power source for the devices may be controlled in response to signals produced from the beat of music or the footsteps of passers-by to control the applied voltage and thereby control the rate of flashing so as to provide an eye-catching and pleasing display.

FIG. 14 is a sectional view illustrating still another modified construction which is in the form of a panel 140 including external plates 141 and 142. The plate 141 is preferably transparent while plate 142 may be either transparent or opaque. A pair of electrodes 143 and 144 are provided, separated by an insulator sheet 145.

In manufacture, the electrodes 143 and 144 are firmly attached to the insulator sheet 145, either by being screened onto the sheet 145 in any of the usual thick-film methods, or by being made of thin metal foil which is glued or cladded to the insulator. Holes are made in all three elements 143–145 simultaneously by punching, drilling, etching or in any other convenient way. If desired, a further etch may be used to make the diameters of the holes in the electrodes 143 and 144 greater than the diameter of the corresponding hole in the insulator sheet 145. With this method of manufacture, the holes in the two electrodes are always aligned with each other and with the holes in the insulator sheet.

The electrode 143 is separated from the transparent insulating plate 141 by an insulating spacer which in the illustrated construction, is in two parts or sections 146 and 147 with a sputter-preventing shield grid 148 interposed therebetween. The spacer formed by sections 146 and 147 may comprise a sheet with holes in it which are of much larger size than the holes in the elements 143, 144 and 145 so that precise alignment is not required and thus manufacturing tolerances are substantially increased. A phosphor layer 149 may be deposited on the inside surface of the plate 141 so that light is produced by excitation of phosphor by the glow discharge.

In operation, the electrode 144 has a much smaller surface exposed to the gas than does the electrode 143. This provides the necessary asymmetry so that when an electrode 143 is a cathode, there is a large-amplitude discharge while when electrode 144 is a cathode, there is a discharge of much smaller amplitude. The exposed surface of the insulator 145 between the two electrodes 143 and 144, holds the charge necessary to produce the random flashing in the manner as above described.

It will be apparent that modes of operation similar to those obtained in the cells in the illustrated embodiments may be obtained using different geometries and structural arrangements, and also that they may be used in other applications. However, the illustrated use for display purposes is one which is highly advantageous, particularly in that a display is obtained which will attract attention from a long distance and which is readily and economically manufacturable, as well as being highly efficient and desirable. The cells or operative portions can be positioned only in certain regions according to the shape of the letters, numerals, or other design to be produced, or they may be uniformly distributed and a mask may be provided over selected portions of a panel. Also, suitable color filters may be disposed over a display or selected portions thereof. It is not essential that the surfaces of the display be flat, and they may be cylindrical or in other contours.

It will be understood that other modifications and variations may be effected without departing from the spirit and scope of the novel concepts of this invention.

What is claimed is:

1. A gas-discharge device comprising: envelope means defining an enclosed space containing an ionizable gas, first and second electrode means within said envelope means, discharge-path means defining a gas-discharge path between a surface portion of said first electrode means and a surface portion of said second electrode means, said discharge-path means including charge-collecting means controlling field conditions along said path as a function of time for controlling the breakdown voltage and hence the time of production of a gas-discharge in said path, said discharge-path means defining a plurality of additional gas-discharge paths between surface portions of said first electrode means and surface portions of said second electrode means, and said discharge-path means including charge-collecting means controlling field conditions along said additional gas-discharge paths as a function of time for controlling the breakdown voltages and hence the time of production of gas discharges in said additional paths, said discharge-path means comprising at least one layer of a fabric material between said first and second electrode means having openings therethrough which provide said discharge paths.

2. In a device as defined in claim 1, said fabric material being a woven material.

3. In a device as defined in claim 1, said fabric material being a felted material.

4. In a device as defined in claim 3, said felted material being a paper formed of ceramic fibers.

5. In a device as defined in claim 4, said paper being an aluminum oxide paper.

6. In a device as defined in claim 1, said fabric material including glass fibers and being substantially free of organic materials.

7. A gas-discharge device comprising: envelope means defining an enclosed space containing an ionizable gas, first and second electrode means within said envelope means, discharge-path means defining a gas-discharge path between a surface portion of said first electrode means and a surface portion of said second electrode means, said discharge-path means including charge-collecting means controlling field conditions along said path as a function of time for controlling the breakdown voltage and hence the time of production of a gas-discharge in said path, said charge-collecting means comprising a member of a dielectric material having an opening therein and having a surface portion extending away from said opening therein and defining a portion of said path, said first electrode means being disposed against said one face of said member of dielectric material and said surface portion of said first electrode means being an annular surface defining an opening larger than and in generally coaxial relation to said opening in said member of dielectric material.

8. In a device as defined in claim 7, said surface portion of said second electrode means being opposite said opening in said member of dielectric material.

9. In a device as defined in claim 8, the area of said surface portion of said first electrode means being a small fraction of the area of said surface portion of said second electrode means.

10. In a device as defined in claim 8, the area of said surface portion of said second electrode means being a small fraction of the area of said surface portion of said first electrode means.

11. In a device as defined in claim 7, said surface portion of said member of dielectric material being of generally frusto-conical shape.

12. In a device as defined in claim 7, said envelope means including a transparent wall adjacent said first electrode means.

13. In a device as defined in claim 12, said annular surface of said first electrode means being a generally frusto-conical surface facing said transparent wall for reflection of light produced by gas discharges out through said transparent wall.

14. In a device as defined in claim 7, said envelope means including a transparent wall adjacent said second electrode means, said surface portion of said second electrode means being an annular surface defining an opening in generally coaxial relation to said opening in said member of dielectric material.

15. In a device as defined in claim 14, said envelope means including a second transparent wall adjacent said first electrode means.

16. A gas-discharge device comprising: envelope means defining an enclosed space containing an ionizable gas, first and second electrode means within said envelope means, discharge-path means defining a gas-discharge path between a surface portion of said first electrode means and a surface portion of said second electrode means, said discharge-path means including charge-collecting means controlling field conditions along said path as a function of time for controlling the breakdown voltage and hence the time of production of a gas-discharge in said path, said discharge-path means defining a plurality of additional gas-discharge paths between surface portions of said first electrode means and surface portions of said second electrode means, and said discharge-path means including charge-collecting means controlling field conditions along said additional gas-discharge paths as a function of time for controlling the breakdown voltages and hence the time of production of gas discharges in said additional paths, said first electrode means comprising a metal sheet having a plurality of openings aligned with said discharge paths.

17. A gas-discharge device comprising: envelope means defining an enclosed space containing an ionizable gas, first and second electrode means within said envelope means, discharge-path means defining a gas-discharge path between a surface portion of said first electrode means and a surface portion of said second electrode means, said discharge-path means including charge-collecting means controlling field conditions along said path as a function of time for controlling the breakdown voltage and hence the time of production of a gas-discharge in said path, said discharge-path means defining a plurality of additional gas-discharge paths between surface portions of said first electrode means and surface portions of said second electrode means, and said discharge-path means including charge-collecting means controlling field conditions along said additional gas-discharge paths as a function of time for controlling the breakdown voltages and hence the time of production of gas discharges in said additional paths, said envelope means including a transparent wall; and said first electrode means having a plurality of openings therethrough permitting viewing of light produced by said discharges through said transparent wall, said first electrode means being of a woven material.

18. A gas-discharge device comprising: envelope means defining an enclosed space containing an ionizable gas, first and second electrode means within said envelope means, discharge-path means defining a gas-discharge path between a surface portion of said first electrode means and a surface portion of said second electrode means, said discharge-path means including charge-collecting means controlling field conditions along said path as a function of time for controlling the breakdown voltage and hence the time of production of a gas-discharge in said path a voltage-supply means for supplying an operating voltage to said first and second electrode means to produce a repeated breakdown operation in which each gas discharge is extinguished after production thereof to leave said charge-collecting means in a certain charge condition and to allow said charge-collecting means to control the time to a next subsequent gas discharge, said device and said voltage-supply means being so arranged and interconnected as to obtain an asymmetrical operation in which the current flow between said first and second electrode means during gas discharges is substantially greater in one direction than in the other direction and said first and second electrode means having different characteristics with respect to at least one of a number of attributes including areas, geometry, work function and secondary-emission ratio to contribute to said asymmetrical operation.

* * * * *